US006669389B2

(12) United States Patent
Gueret

(10) Patent No.: US 6,669,389 B2
(45) Date of Patent: Dec. 30, 2003

(54) DEVICE FOR APPLYING A PRODUCT AND METHOD FOR MANUFACTURING DEVICE

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/094,660

(22) Filed: Mar. 12, 2002

(65) Prior Publication Data

US 2002/0164192 A1 Nov. 7, 2002

Related U.S. Application Data

(63) Continuation-in-part of application No. PCT/FR01/01911, filed on Jun. 19, 2001.

(30) Foreign Application Priority Data

Jul. 12, 2000 (FR) ..... 00 09115
Apr. 13, 2001 (FR) ..... 01 05110
Jun. 5, 2001 (FR) ..... 01 07310

(51) Int. Cl.[7] ..... A46B 11/00; A46B 15/00

(52) U.S. Cl. ..... 401/122; 15/160; 15/167.1; 15/167.3; 15/206; 132/218; 132/313; 132/317; 401/127; 401/129; 401/268

(58) Field of Search ..... 401/122, 127, 401/129, 268; 15/160, 167.1, 167.3, 206; 132/218, 313, 317

(56) References Cited

U.S. PATENT DOCUMENTS

| | | | |
|---|---|---|---|
| 1,968,475 | A | 7/1934 | Beckwith et al. |
| 3,325,845 | A | 6/1967 | Sawkiw |
| 3,428,043 | A | 2/1969 | Shepherd |
| 3,499,446 | A | 3/1970 | Tsuneizumi et al. |
| 4,156,067 | A | 5/1979 | Gould |

(List continued on next page.)

FOREIGN PATENT DOCUMENTS

| | | |
|---|---|---|
| DE | 1 629 523 | 2/1971 |
| DE | (U) 86 10 769 | 4/1986 |
| DE | 36 13 280 | 10/1987 |
| DE | 36 19 987 | 12/1987 |
| DE | 43 25 071 | 1/1995 |

(List continued on next page.)

OTHER PUBLICATIONS

Co–pending application No. 09/709,397; Attorney Docket No. 05725.0796–00000, Title: Applicator Device and System Having Particle–Laden Bristles, Method for Applying Product, and Method of Making Particle–Laden Bristles, Inventor(s): Jean–Louis H. Gueret, U.S. Filing Date: Nov. 13, 2000, Amendment filed Jan. 11, 2002, Amendment filed Jun. 21, 2002, Response to Election of Species Requirement filed Aug. 30, 2002.

Co–pending application No. 10/161,726; Attorney Docket No. 08048.0033–00000, Title: Fiber and Device For Applying A Product, and Method of Manufacturing Device, Inventor(s): Jean–Louis H. Gueret, U.S. Filing Date: Jun. 5, 2002.

English language Derwent Abstract of DE 195 34 368, Mar. 20, 1997.

English language Derwent Abstract of EP 1 099 394, May 16, 2001.

Minolta brochure, "Precise Color Communication", 1994.

Minolta brochure, "Spectrophotometer CM–2002", 1991.

(List continued on next page.)

*Primary Examiner*—Gregory L. Huson
*Assistant Examiner*—Kathleen J. Prunner
(74) *Attorney, Agent, or Firm*—Finnegan, Henderson, Farabow, Garrett & Dunner, LLP

(57) ABSTRACT

A device for applying a make-up product includes an applicator element including a plurality of fibers. The applicator element is configured to apply a make-up product, and at least one of the fibers includes at least one particle configured to generate a magnetic field.

203 Claims, 7 Drawing Sheets

U.S. PATENT DOCUMENTS

| | | | | | |
|---|---|---|---|---|---|
| 4,337,859 | A | | 7/1982 | Murphy et al. | |
| 4,377,160 | A | | 3/1983 | Romaine | |
| 4,427,001 | A | | 1/1984 | Kiefer et al. | |
| 4,464,535 | A | | 8/1984 | Szantay et al. | |
| 4,548,861 | A | | 10/1985 | Barnes et al. | |
| 4,571,768 | A | | 2/1986 | Kawashima | |
| 4,585,797 | A | | 4/1986 | Cioca | |
| 4,631,227 | A | | 12/1986 | Nakamura | |
| 4,643,939 | A | | 2/1987 | Sugiyama et al. | |
| 4,724,138 | A | | 2/1988 | Duffy et al. | |
| 4,804,538 | A | | 2/1989 | Chen | |
| 4,814,167 | A | | 3/1989 | Wirth et al. | |
| 4,927,281 | A | | 5/1990 | Gueret | |
| 4,940,350 | A | | 7/1990 | Kim | |
| 4,958,402 | A | | 9/1990 | Weibrauch | |
| 4,993,440 | A | | 2/1991 | Gueret | |
| 5,026,552 | A | | 6/1991 | Gueret et al. | |
| 5,049,376 | A | | 9/1991 | Murphy et al. | |
| 5,100,672 | A | | 3/1992 | Gueret et al. | |
| 5,161,554 | A | | 11/1992 | Fitjer | |
| 5,232,707 | A | | 8/1993 | Lokensgard | |
| 5,269,040 | A | | 12/1993 | Switall | |
| 5,349,972 | A | | 9/1994 | Dirksing et al. | |
| 5,357,647 | A | | 10/1994 | Gueret | |
| 5,374,429 | A | | 12/1994 | Kinoshita et al. | |
| 5,386,278 | A | | 1/1995 | Maeyama et al. | |
| 5,466,456 | A | | 11/1995 | Glover | |
| 5,466,724 | A | | 11/1995 | Volke et al. | |
| 5,512,277 | A | | 4/1996 | Uemura et al. | |
| 5,567,072 | A | | 10/1996 | Dunleavy et al. | 401/129 |
| 5,702,713 | A | | 12/1997 | Joulia | |
| 5,762,432 | A | | 6/1998 | Dunleavy et al. | 401/129 |
| 5,798,110 | A | | 8/1998 | Joulia | |
| 5,799,356 | A | * | 9/1998 | Kawashima | 15/167.1 |
| 5,800,835 | A | | 9/1998 | Zastrow et al. | |
| 5,811,107 | A | | 9/1998 | Gangadharan et al. | |
| 5,861,165 | A | | 1/1999 | Joulia | |
| 5,919,490 | A | | 7/1999 | Zastrow et al. | |
| 5,935,596 | A | | 8/1999 | Crotty et al. | |
| 5,958,443 | A | | 9/1999 | Viegas et al. | |
| 5,961,988 | A | | 10/1999 | Zastrow et al. | |
| 5,987,691 | A | | 11/1999 | Jurt et al. | |
| 6,073,634 | A | | 6/2000 | Gueret | |
| 6,096,333 | A | | 8/2000 | Rolf et al. | |
| 6,163,918 | A | | 12/2000 | Weihrauch | |
| 6,174,600 | B1 | | 1/2001 | Brown et al. | |
| 6,269,514 | B1 | | 8/2001 | Edwards et al. | |
| 6,305,863 | B1 | | 10/2001 | Gueret | |
| 6,309,124 | B1 | | 10/2001 | Gueret | |
| 6,311,359 | B1 | | 11/2001 | Brezler, III | |
| 6,343,607 | B1 | | 2/2002 | Gueret | |
| 6,475,553 | B2 | * | 11/2002 | Guay et al. | 427/2.29 |
| 2001/0003600 | A1 | * | 6/2001 | Guay | 427/2.29 |

FOREIGN PATENT DOCUMENTS

| | | |
|---|---|---|
| DE | 44 46 380 | 1/1996 |
| DE | 195 34 368 | 3/1997 |
| DE | 197 15 477 | 10/1998 |
| DE | 197 15 478 | 10/1998 |
| EP | 0 063 875 | 11/1982 |
| EP | 0 190 814 | 8/1986 |
| EP | 0 191 198 | 8/1986 |
| EP | 0 309 309 | 3/1989 |
| EP | 0 412 869 | 2/1991 |
| EP | 0 528 705 | 2/1993 |
| EP | 0 651 984 | 5/1995 |
| EP | 0 764 441 | 3/1997 |
| EP | 1 043 018 | 10/2000 |
| EP | 1 099 394 | 5/2001 |
| FR | 1 520 770 | 4/1968 |
| FR | 2 276 030 | 1/1976 |
| FR | 2 515 651 | 5/1983 |
| FR | 2 519 580 | 7/1983 |
| FR | 2 538 247 | 6/1984 |
| FR | 2 607 372 | 6/1988 |
| FR | 2 627 068 | 8/1989 |
| FR | 2 687 055 | 8/1993 |
| FR | 2 738 744 | 3/1997 |
| FR | 2 750 050 | 12/1997 |
| FR | 2 776 518 | 10/1999 |
| GB | 2 265 086 | 9/1993 |
| GB | 2 307 862 | 6/1997 |
| JP | 61-112602 | 5/1986 |
| JP | 61-141307 | 6/1986 |
| JP | 61-187808 | 8/1986 |
| JP | H10-167928 | 6/1998 |
| JP | H10-245319 | 9/1998 |
| JP | H10-287587 | 10/1998 |
| JP | 10-324614 | 12/1998 |
| JP | 11-113638 | 4/1999 |
| JP | 2001-178541 | 7/2001 |
| WO | WO 87/05206 | 9/1987 |
| WO | WO 92/14435 | 9/1992 |
| WO | WO 94/02674 | 2/1994 |
| WO | WO 94/17837 | 8/1994 |
| WO | WO 94/22423 | 10/1994 |
| WO | WO 95/05204 | 2/1995 |
| WO | WO 95/28136 | 10/1995 |
| WO | WO 96/14822 | 5/1996 |
| WO | WO 96/37283 | 11/1996 |
| WO | WO 98/31315 | 7/1998 |
| WO | WO 98/42303 | 10/1998 |
| WO | WO 99/42376 | 8/1999 |
| WO | WO 00/02468 | 1/2000 |

OTHER PUBLICATIONS

Co–pending application No. 09/790,794, Attorney Docket No. 08048.0011–00000, Title: Device Having a Magnetic Applicator and/or Wiper Member, Inventor(s): Jean–Louis H. Gueret, U.S. Filing Date: Feb. 22, 2001, Preliminary Amendment Filed Mar. 19, 2002 (copy enclosed).

English Language Derwent Abstract of EP 0 528 705, Feb. 24, 1993.

English Language Derwent Abstract of EP 0 764 441, Mar. 26, 1997.

English Language Derwent Abstract of EP 1 043 018, Oct. 11, 2000.

English Language Derwent Abstract of DE 1 629 523, Feb. 4, 1971.

English Language Derwent Abstract of DE 3 613 280, Oct. 22, 1987.

English Language Derwent Abstract of DE 36 19 987, Dec. 17, 1987.

English Language Derwent Abstract of DE 44 46 380, Jan. 11, 1996.

English Language Derwent Abstract of DE 197 15 477, Oct. 15, 1998.

English Language Derwent Abstract of FR 1 520 770, Apr. 12, 1968.

English Language Derwent Abstract of FR 2 276 030, Jan. 23, 1976.

English Language Derwent Abstract of FR 2 519 580, Jul. 18, 1983.

English Language Derwent Abstract of FR 2 538 247, Jun. 29, 1984.

English Language Derwent Abstract of FR 2 738 744, Mar. 21, 1997.
English Language Derwent Abstract of FR 2 750 050, Dec. 26, 1997.
English Language Derwent Abstract of FR 2 776 518, Oct. 1, 1999.
English Language Derwent Abstract of JP 10–324614, Dec. 8, 1998.
English Language Derwent Abstract of JP 61–112602, May 30, 1986.
English Language Translation of JP 61–187808, Aug. 21, 1986.
English Language Derwent Abstract of JP 2001–178541, Jul. 3, 2001.
Patent Abstracts of Japan, JP 55 081809, Jun. 20, 1980.
Patent Abstracts of Japan, vol. 017, No. 571, Oct. 18, 1993, JP 05 168530.
Patent Abstracts of Japan, Vo. 018, No. 521, Sep. 30, 1994, JP 06 179411.
Patent Abstracts of Japan, vol. 1999, No. 09, Jul. 30, 1999, JP 11 113638.
Patent Abstracts of Japan, vol. 2000, No. 09, Oct. 13, 2000, JP 2000 175942.

English language translation of Japanese Patent Application H10–167928, Jun. 23, 1998.

English language translation of Japanese Patent Application H10–245319, Sep. 14, 1998.

English language translation of Japanese Patent Application H10–287587, Oct. 27, 1998.

English language translation of Japanese Laid Open Patent Publication 11–113638, Apr. 27, 1999.

From copending U.S. patent application Ser. No. 09/790, 794, Attorney Docket No. 08048.0011–00000, Amendment and Response to Electron of Species filed: Oct. 18, 2002; Amendment filed: Apr. 3, 2003; and Supplemental Amendment filed: Apr. 4, 2003.

Supplement Amendment filed: Apr. 4, 2003.

* cited by examiner

DEVICE FOR APPLYING A PRODUCT AND METHOD FOR MANUFACTURING DEVICE

This application is a continuation-in-part of PCT international application PCT/FR01/01911, filed Jun. 19, 2001, which claims the benefit of priority based on French Application Nos. 00/09115, 01/05110, and 01/07310, filed Jul. 12, 2000, Apr. 13, 2001, and Jun. 5, 2001, respectively.

The present invention relates to a device for applying a product, for example, applying a make-up or a care product to the skin, to the hair, to the eyelashes, to the finger nails, and/or to the toe nails.

Cosmetics are increasingly incorporating one or more active agents for care of a treated surface. For example, agents such as hydrating agents or anti-wrinkle agents may be applied. It may be desirable to encourage penetration of such agents in order to boost their effectiveness. For example, German Patent No. 4 325 071 describes using magnetic particles dispersed in a cream, a lotion, a gel, or on a dressing to encourage blood circulation.

There exists a need to improve the ease with which a product may be extracted from a receptacle, to improve the application of a product on a surface to be treated, and to create novel make-up effects.

In the following description, certain aspects will become evident. It should be understood that the invention, in its broadest sense, could be practiced without having one or more of these aspects.

In one aspect, as embodied and broadly described herein, the invention includes a device for applying a make-up product. The device includes an applicator element including a plurality of fibers. The applicator element may be configured to apply a make-up product, and at least one of the fibers may include at least one particle configured to generate a magnetic field.

As used herein, the term "fiber" means any generally elongate body (e.g., a bristle of a brush (e.g., a bristle of a mascara brush, nail varnish brush, paint brush, or blusher brush), a fiber in a flocking, a bristle in a paint brush, a fiber for applying a powder, fibers included in a filler for a product for applying to eyelashes (e.g., for lengthening the eyelashes)). The fibers may be relatively flexible, for example, elastically deformable, and the fibers may comprise a synthetic material.

In yet another aspect, a device for applying a product may be provided including an applicator element including a plurality of fibers. At least one of the plurality of fibers may include a plurality of particles configured to generate a magnetic field.

In another aspect, a device for applying a product may be provided including an applicator element including a porous member and a plurality of fibers extending from the porous member. At least one of the plurality of fibers may include at least one magnetic particle configured to generate a magnetic field.

According to yet another aspect, a device for applying a product may be provided with a core configured to generate a magnetic field and a plurality of application members connected to the core. At least one of the application members may be configured to interact magnetically with the core.

In still another aspect, a device for applying a product may include an applicator element including a plurality of fibers configured to be loaded with the product and to apply the loaded product. At least one of the fibers may include at least one particle configured to generate a magnetic field. The device may further include a receptacle configured to contain the product to be applied and the receptacle may define a recess configured to receive the applicator element.

In a further aspect, a device for applying a product may include an applicator element including a flocking. The flocking may include a plurality of fibers. At least one of the fibers may include at least one particle configured to generate a magnetic field.

In an additional aspect, a device for applying a product may include an applicator element defining an axis. The applicator element may include a plurality of bristles extending in a direction at least substantially parallel to the axis of the applicator element. At least one of the bristles may include at least one particle configured to generate a magnetic field.

The magnetic properties of fibers in accordance with some exemplary embodiments of the invention may be used in multiple ways. For example, a magnetic field having a predefined or varying orientation may be generated by the fibers when a product is applied, for example, thereby encouraging microcirculation and penetration of active agents. By making use of any magnetic interactions between the fibers and/or by making use of the manner in which the fibers may react to an external magnetic field, it may be possible to orient the fibers in a particular arrangement while the fibers are loaded with product, for example, during optional wiping of the product and/or during application of the product, thereby possibly increasing the quantity of product loaded onto the applicator resulting in, for example, greater ease of application of the product.

In some exemplary embodiments of magnetic bodies used for conferring magnetic properties to fibers, it may be possible, for example, to impart a biocidal action suitable for enhancing conservation of a product (e.g., a cosmetic and/or a care product) in contact therewith.

In one aspect of the device, at least one of the fibers may include a synthetic material. In addition, at least one of the fibers may have a cross-section that is substantially constant. At least one of the fibers may be formed by one of extruding and co-extruding at least one of a thermoplastic material and an elastomeric material. For example, the plastic material used may contain a filler of magnetic particles, and the fiber may be formed by co-extrusion of two synthetic materials, with one of the two synthetic materials being filled with magnetic particles, for example. In another aspect, at least one of the fibers may include a non-magnetic inner portion and a coating comprising magnetic particles. The fibers may be formed by coating one or more magnetic bodies in at least one non-magnetic material, or by coating a nonmagnetic material (e.g., a fiber of wood, rayon, nylon, cotton, or polyethylene) in magnetic particles, which may also be encapsulated in a resin. For example, the magnetic particles may be particles coated in a resin (e.g., cyanoacrylate) or they may be formed by depositing a magnetic substance on a non-magnetic medium (e.g., a glass microbead or a wood fiber).

In another aspect, at least one of the fibers may include not only a synthetic material and magnetic particles, but the at least one fiber may also include particles capable of absorbing a liquid and/or a component in solution in the liquid, and/or the at least one fiber may also include particles capable of dissolving in a liquid. The liquid may include, for example, water, an oil, an alcohol, and/or any type of solvent. One exemplary embodiment may also provide a porous magnetic fiber. Another exemplary embodiment may provide a textured magnetic fiber.

In yet another aspect, at least one particle may at least partially include at least one material chosen from soft magnetic materials, hard magnetic materials, ferrites, ferrites based on zinc, ferrites based on nickel, ferrites based on manganese, rare earth elements, barium sulfates, silicon iron alloys, cobalt irons, and cobalt irons filled with molybdenum.

In a further aspect, at least one of the fibers may include one of magnetized particles and magnetizable particles, wherein the particles comprise an amount ranging from about 0.2% to about 30% by weight. At least one of the fibers may include at least one plastic material chosen from polyamides, polyethylene terephthalates (PETs), acetates, polyethylenes (PEs), polypropylenes (PPs), polyvinylchlorides (PVCs), amide block polyesters, plasticized RILSAN (which is believed to be a form of polyamide), elastomers, polyester elastomers, PE elastomers, silicone elastomers, and nitril elastomers. The plastic material selected may present properties whereby the selected material swells and/or softens upon coming into contact with a product (e.g., a cosmetic product and/or a care product) that comes into contact therewith, for example, water contained in the product. The fibers may contain particles of one or more materials selected from the following list: polymers that swell in water or in fat; super-absorbent cross-linked polyacrylates having a high swelling factor in water; poly-vinyl alcohol; carboxyvinyl polymers; semi-synthetic derivatives of cellulose; starches; bio-gums; biosaccharides; scleroglucanes; casein; phytocalloids such as alginates; gelatin; cotton fibers; gelanes; xanthan; laponite; silicas, colloidal silicas; or mixtures thereof.

In still another aspect, the at least one particle may be at the surface of the at least one fiber. The at least one fiber may include magnetic particles only at the surface of the at least one fiber or the at least one fiber may include magnetic particles solely inside the at least one fiber. Alternatively, the at least one fiber may include magnetic particles dispersed throughout the at least one fiber.

According to an additional aspect, the cross-section of at least one of the fibers may be at least one shape chosen from circularly symmetric shapes, circular shapes, solid square shapes, hollow square shapes, disk shapes, disk shapes having a groove, solid triangle shapes, hollow triangle shapes, solid star shapes, hollow star shapes, U-shaped, V-shaped, I-shaped, T-shaped, Z-shaped, dash-shaped, cross-shaped, kidney-shaped, shapes having three branches, and hollow shapes.

In another aspect, the fibers may be merely magnetizable (i.e., they may become magnetized in response to exposure of a magnetic field) without being magnetized. In another embodiment, the fibers may be magnetized (i.e., they may generate a substantially permanent magnetic field).

Exemplary embodiments of the invention may be applied to a large number of applicator devices. The fibers presenting the magnetic properties may belong to the applicator device and/or the fibers presenting magnetic properties may be contained in the product.

In one exemplary embodiment, the device may include an applicator element having magnetized and/or magnetizable fibers along with a receptacle containing a product that contains particles suitable for being attracted by the magnetic field exerted by the fibers of the applicator element. For example, according to one exemplary embodiment, the device may include an applicator element having magnetized and/or magnetizable fibers and a receptacle containing a product that contains magnetized and/or magnetizable particles. The fibers may be suitable for being subjected to the magnetic action of the particles. In either case, the magnetic interactions between the fibers and the product may contribute to improved loading of the applicator element with the product.

In another aspect, the device may include a wiper member. In addition, the wiper member may be configured to generate a magnetic field (e.g., for the purpose of magnetizing an applicator element that includes magnetizable fibers) while the applicator element is withdrawn from the receptacle and/or for improving the quality of wiping. The applicator element may be a mascara brush and at least one of the bristles of the mascara brush may include at least one of the fibers. The bristles of the brush may be secured to a twisted core, which may or may not be magnetized.

In still a further aspect, the device may include a receptacle and a product (e.g., a make-up product) contained in the receptacle. The applicator element and the product may be configured such that the product is attracted to the applicator element (e.g., the product is attracted to the at least one fiber of the applicator element). For example, the product contained in the receptacle may include magnetized and/or magnetizable particles and at least one fiber may be configured to interact with the magnetized and/or magnetizable particles of the product.

According to another aspect, the applicator element may be a mascara brush including a plurality of bristles. At least one of the bristles may include at least one of the fibers configured to generate a magnetic field. The mascara brush may further include a magnetized core. The magnetized core may be twisted such that the plurality of bristles are connected to the magnetized core.

In yet another aspect, the applicator element may be a paint brush including a plurality of bristles, with at least one of the bristles including at least one of the fibers configured to generate a magnetic field.

According to yet another aspect, the applicator element may include a flocking including the plurality of fibers. The device may be configured so that flocking covers at least a portion of one of teeth, bristles, a wiper, a foam member, a porous member, a film, a perforated film, an endpiece, a woven fabric, and a non-woven fabric. In another aspect, the applicator element may include one of a woven fabric, a non-woven fabric, and a felt comprising the plurality of fibers. As discussed herein, the fibers may be fixed on many types of media, which may be magnetized so as to subject the fibers to a magnetic field and cause them, for example, to take up a particular configuration and/or to become magnetized. The fibers may be subjected to a magnetic field of a magnet fixed on a medium. The device may also contain a composition including a filler that includes at least some of the fibers.

In still another aspect, the plurality of fibers may be exposed to a magnetic field.

According to an additional aspect, the device may include a product (e.g., make-up product) including a plurality of fibers, at least one of the plurality of fibers of the product may include at least one particle configured to generate a magnetic field.

In another aspect, at least one of the fibers may have a diameter ranging from about 0.5 $\mu$m to about 500 $\mu$m, and at least one of the fibers may have a length ranging from about 0.5 mm to about 50 mm.

In yet another aspect, the plurality of fibers may include flocking on an application surface of the application element. Alternatively, the plurality of fibers may include a plurality of bristles.

According to an additional aspect, the applicator element may define an axis and a plurality of bristles may extend in substantially the same direction as the axis of the applicator element. The applicator element may further include branches of wire holding the plurality of bristles.

In another aspect, the device may include a receptacle containing a product (e.g., make-up product). The receptacle may be provided with an opening configured to receive the applicator element.

In an additional aspect, a method of manufacturing a device for applying a product may include exposing the plurality of fibers to a magnetic field. Exposing the fibers to a magnetic field may arrange the plurality of fibers in a desired orientation.

In another aspect, there is a method of applying a product. The method comprises providing the device, loading the applicator element with product and applying the loaded product to skin, hair (e.g., eyelashes, eyebrows, and/or scalp hair), and/or nails (e.g., finger nails and/or toe nails) via the device.

The term "providing" is used in a broad sense, and refers to, but is not limited to, making available for use, enabling usage, giving, supplying, obtaining, getting a hold of, acquiring, purchasing, selling, distributing, possessing, making ready for use, and/or placing in a position ready for use.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic cross-section view of an embodiment of a fiber;

FIG. 9O is a schematic view of a cross-section of another embodiment of a fiber;

Reference will now be made in detail to some possible embodiments of the invention, examples of which are illustrated in the accompanying drawings. Wherever possible, the same reference numbers are used in the drawings and the description to refer to the same or like parts.

Figure 1:
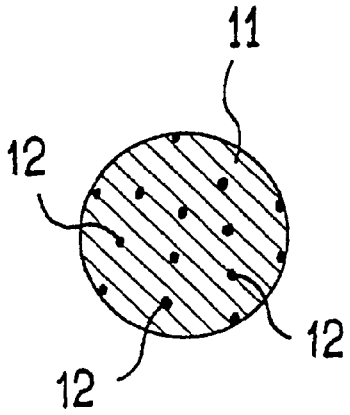
Figure 31:
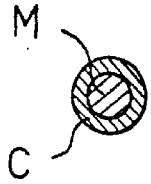
FIG. 31 is a schematic cross-section view of one embodiment of a particle.
Figure 32:
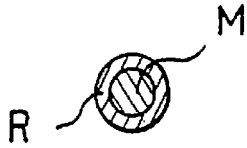
FIG. 32 is a schematic cross-section view of one embodiment of a particle.

FIG. 1 is a schematic cross-section view of an embodiment of a fiber that can be used in a device and system for applying a product to a surface. In this exemplary embodiment, the fiber 11 may be formed by extruding a material (e.g., a thermoplastic material) that may contain a filler of particles 12 configured to generate a magnetic field. The particles 12 may be formed, for example, by fragmenting a magnetic substance or by depositing a magnetic substance M on a non-magnetic body C (e.g., a microbead or a wood fiber) as shown in FIG. 31. The particles 12 may also be configured in the form of magnetic cores M having non-magnetic outer coverings R (e.g., a layer of resin, for example, a layer of cyanoacrylate), as shown in FIG. 32. In the exemplary embodiment shown, the fiber 11 may be solid and may be circular in cross-section. As explained herein, however, the fiber 11 may have other cross-sections.

Figure 10:
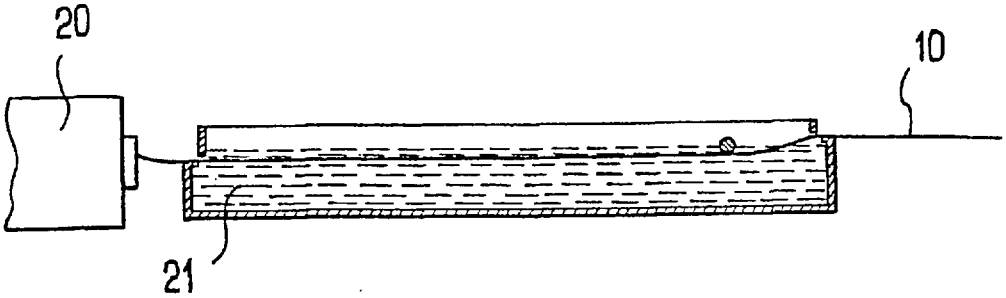
FIG. 10 is a schematic side view of fibers being manufactured according to one embodiment.

According to one exemplary aspect, the fiber 11 may be formed using an arrangement as shown in FIG. 10. Such an exemplary arrangement may comprise an extruder 20 and a bath 21 of liquid (e.g., a cooling liquid) into which the fibers 12 may be immersed upon leaving the extruder 20.

Figure 2:
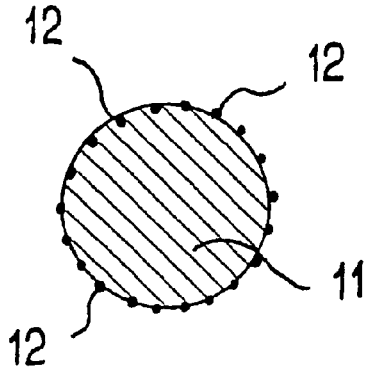
FIG. 2 is a schematic cross-section view of another embodiment of a fiber.
Figure 3:
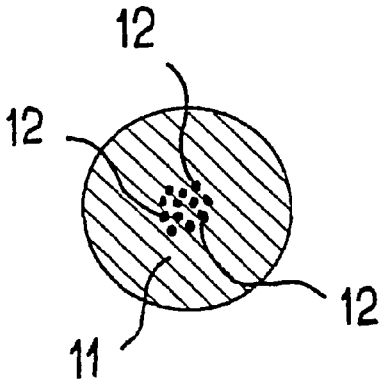
FIG. 3 is a schematic cross-section view of another embodiment of a fiber.
Figure 4:
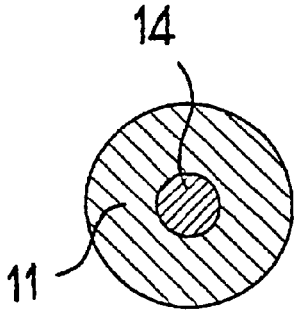
FIG. 4 is a schematic cross-section view of another embodiment of a fiber.

The invention is not, however, limited to fibers 11 including particles 12 dispersed substantially uniformly within the material. For example, the particles 12 may be deposited solely on the surface of the fibers 11 by a method such as coating, for example, as shown in FIG. 2. Alternatively, the particles 12 may be confined to the inside of the fiber 11, as shown in FIG. 3. The particles 12 may also be configured in the form of a core 14, as shown in FIG. 4. The fibers 11 may also be formed by coating a non-magnetic inner fiber portion with particles (e.g., magnetic particles) and then encapsulating the coated fibers in a resin. The content of the particles 12 by weight in a fiber 11 may range from about 0.2% to about 30%, for example, and the materials (e.g., magnetic materials) used may be, for example, any of those materials mentioned herein.

The fibers 11 may include fillers having particles 12 that generate a magnetic field in addition to fillers of particles suitable for absorbing and/or swelling on contact with a liquid (e.g., a make-up product, a cosmetic, and/or a care product) that is to be applied. For example, the fiber 11 may include particles 12 that are liquid-absorbing and/or particles 12 that swell in the presence of a liquid (e.g., water). Such liquid-absorbing materials may include, but are not limited to, one or a mixture of the following: polymers that swell in a liquid and/or in a fat; super-absorbent cross-linked polyacrylates having a large swelling factor in liquid; polyvinyl alcohol; carboxyvinyl polymers; semi-synthetic derivatives of cellulose; starches; bio-gums; biosaccharides; scleroglucanes; casein; phytocolloids such as alginates; gelatin; cotton fibers; gelanes; xanthan; laponite; and silicas such as colloidal silica.

Figure 5A:
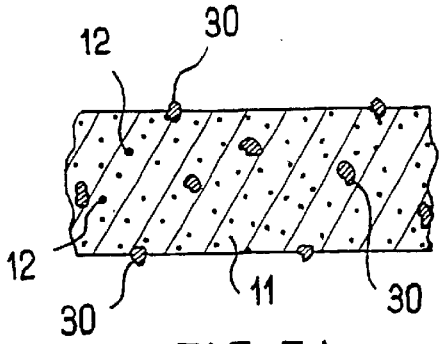
FIG. 5A is a schematic axial cross-section view of another embodiment of a fiber.
Figure 5B:
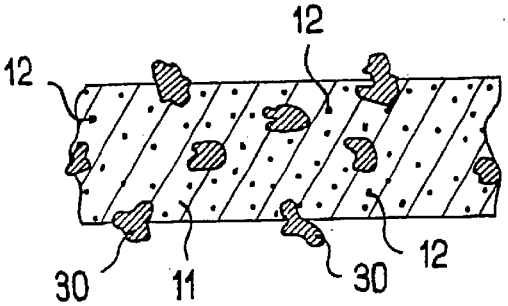
FIG. 5B is a schematic axial cross-section view of another embodiment of a fiber.

For example, FIG. 5A shows a fiber 11 prior to coming into contact with a liquid (e.g., water) including a filler of particles 30 of a material that swells in a liquid. FIG. 5B shows the fiber 11 of FIG. 5A after contacting the liquid. The swelling of the particles 30 may produce a relief on the surface of the fiber 11. Such a relief may be useful, for example, for enabling the fiber 11 to pick up a greater quantity of product and/or to better catch hold of eyelashes when the fiber 11 is used as a bristle in a mascara brush, for example.

The particles 30 may also be useful for absorbing one or more substances (e.g., preservatives and/or make-up agents, cosmetic agents, and/or active dermatological agents) into the fiber 11. For example, the bath 21 that may be used for cooling the fibers 11 when they leave the extruder 20 may include one or more materials (e.g., preservatives) dissolved in the liquid of the bath 21. Such materials may be absorbed by the particles 30 when the fibers 11 are in immersed in the bath 21. The fibers 11 may leave the bath 21 filled with materials which have been absorbed by the particles 30 contained in the fibers 11. These materials may subsequently be released (e.g., progressively) when in the presence of a product (e.g., a cosmetic product or a care product) so as to improve conservation of the product, for example. The fibers 11 may be dehydrated on leaving the bath 21.

In addition to having particles 12 possessing the properties mentioned previously, the fibers 11 may also contain particles 40 that are at least partially soluble in a liquid (e.g., the liquid in the bath 21 used for cooling the fibers upon leaving the extruder 20). The particles 40 may comprise, for example, a salt and/or a sugar that is soluble in the liquid used, or a gelatin when the liquid is water.

Figure 6A:
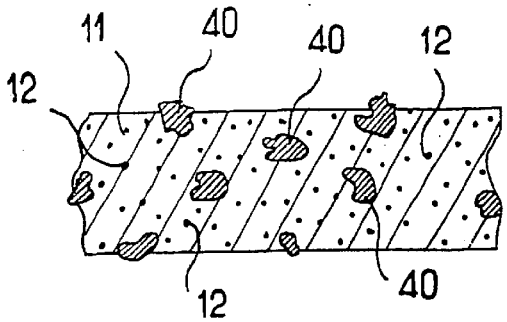
FIG. 6A is a schematic axial cross-section view of another embodiment of a fiber.
Figure 6B:
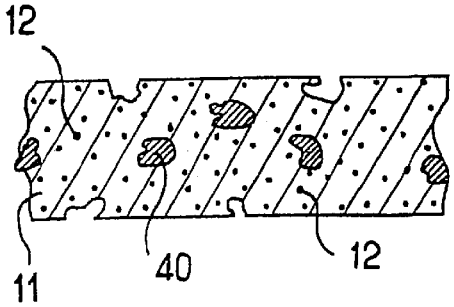
FIG. 6B is a schematic axial cross-section view of another embodiment of a fiber.

FIG. 6A shows a fiber 11 containing particles 40 prior to dissolution (i.e., immediately after leaving the extruder 20), and FIG. 6B shows the fiber 11 of FIG. 6A after it has passed through the bath 21. As shown, the soluble particles 40 that were present on the surface of the fiber 11 may be dissolved by the liquid in the bath 21, for example, thereby creating roughness of the surface of the fiber 11, possibly resulting in the fiber 11 being at least somewhat porous. Such roughness or porosity may be used for increasing the amount of product that can be loaded onto the fiber 11. The roughness or porosity that is obtained may depend on the initial grain size of the particles 40. The particles 40 may also be only partially dissolved upon leaving the bath 21, and may further dissolve when coming into contact with a product (e.g., a cosmetic product or a care product) that is present on the surfaces of the particles 40. The particles 40 may comprise one or more substances having a cosmetic or a dermatological effect, for example. In such a case, the particles 40 may dissolve when in contact with the product and may accompany these cosmetic or dermatological substances being released on the treated surface.

In another exemplary aspect, the fibers 11 may be exposed to shocks seeking to cause or facilitate removal of the particles 40 present on the surface. The particles 40 may also be formed of a material which is not soluble in the liquid of the bath 21, but which is soluble, progressively, only in the product present (e.g., a cosmetic product or a care product) when the product comes into contact with the fibers 11.

Figure 7:
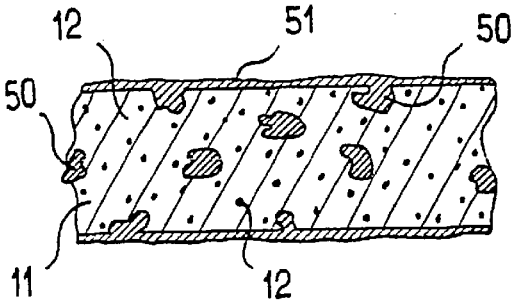
FIG. 7 is a schematic axial cross-section view of another embodiment of a fiber.

In addition to the previously mentioned particles, it may also be possible to introduce particles 50 into the fibers 11 that are suitable for gelling upon coming into contact with a liquid, so as to form a layer of gel 51 on the surface of the fiber 11, as shown in FIG. 7. A layer of gel 51 may alter the affinity of the fiber 11 for a cosmetic product or a care product that comes into contact therewith, for example. The gel 51 may also be deposited on the surface, for example, the eyelashes, so as to improve their strength, their appearance, and/or the way the applicator slides in contact therewith.

The use of particles 12 capable of absorbing a liquid (e.g., water) may also present an advantage of delaying drying of a product (e.g., a cosmetic product and/or a care product) on the surface of the fiber 11 if the liquid absorbed by the particles 12 is suitable for being released progressively, thereby compensating for the evaporation of a solvent contained in the composition.

Figure 8:
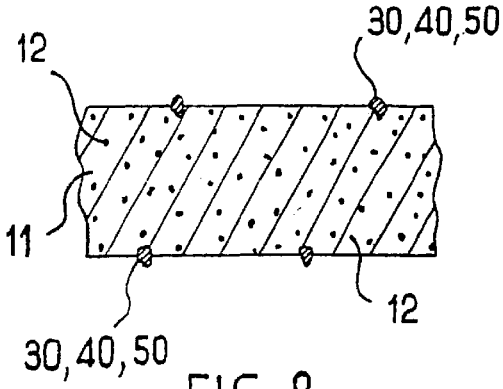
FIG. 8 is a schematic axial cross-section view of another embodiment of a fiber.

The use of particles such as 30, 40, or 50 may also make it possible to create privileged zones on the surface of the fiber 11 for anchoring a product, for example, the cosmetic or care product (i.e., because of affinity between the particles used and the hdyrophilic or lipophilic compounds contained in said product). The product may optionally be in the form of an oil/water emulsion and the fibers 11 may absorb either oil or water only, and more generally, the fibers 11 may absorb one of the components of the product in selective manner. Particles 30, 40, or 50 presenting properties other than magnetic properties, where appropriate, may be present on the surface only of the fibers 11, as shown in FIG. 8.

The initial grain size of the particles 30, 40, and 50 may range from about 0.1 $\mu$m to about 300 $\mu$m, or from about 5 $\mu$m to about 200 $\mu$m, or from about 10 $\mu$m to about 150 $\mu$m. The fibers 11 may comprise by dry weight of particles 30, 40, and/or 50, a range from about 0% to about 20%, or a range from about 0% to about 6%.

Figure 9A:
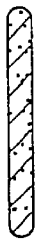
FIG. 9A is a schematic view of a cross-section of one embodiment of a fiber.
Figure 9B:
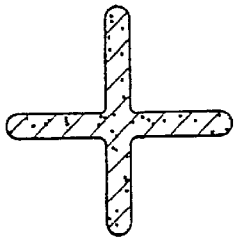
FIG. 9B is a schematic view of a cross-section of another embodiment of a fiber.
Figure 9C:
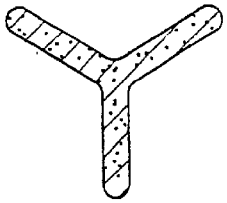
FIG. 9C is a schematic view of a cross-section of another embodiment of a fiber.
Figure 9D:
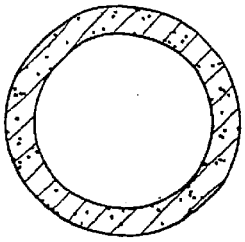
FIG. 9D is a schematic view of a cross-section of another embodiment of a fiber.
Figure 9E:
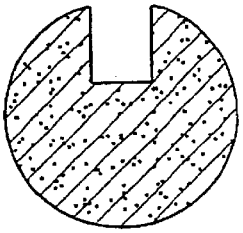
FIG. 9E is a schematic view of a cross-section of another embodiment of a fiber.
Figure 9F:
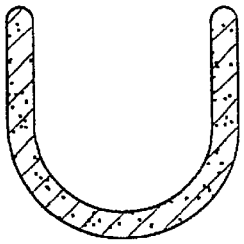
FIG. 9F is a schematic view of a cross-section of another embodiment of a fiber.
Figure 9G:
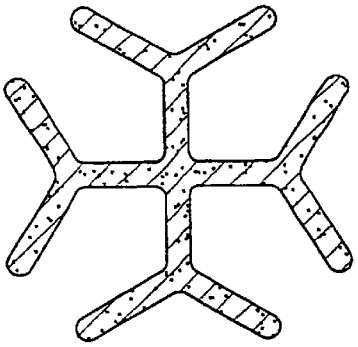
FIG. 9G is a schematic view of a cross-section of another embodiment of a fiber.
Figure 9H:
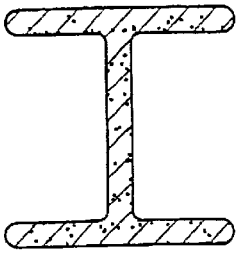
FIG. 9H is a schematic view of a cross-section of another embodiment of a fiber.
Figure 9I:
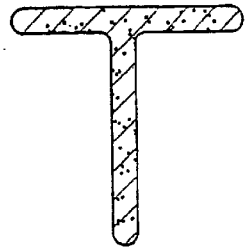
FIG. 9I is a schematic view of a cross-section of another embodiment of a fiber.
Figure 9J:
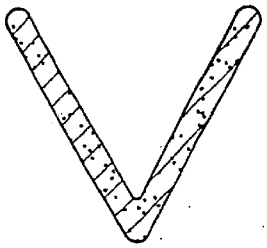
FIG. 9J is a schematic view of a cross-section of another embodiment of a fiber.
Figure 9K:
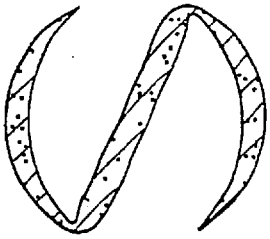
FIG. 9K is a schematic view of a cross-section of another embodiment of a fiber.
Figure 9L:
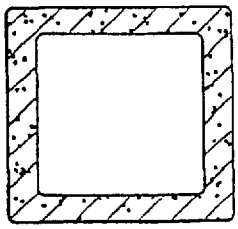
FIG. 9L is a schematic view of a cross-section of another embodiment of a fiber.
Figure 9M:
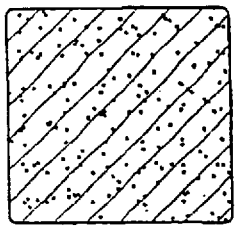
FIG. 9M is a schematic view of a cross-section of another embodiment of a fiber.
Figure 9N:
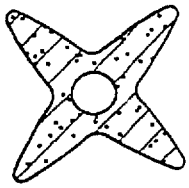
FIG. 9N is a schematic view of a cross-section of another embodiment of a fiber.
Figure 9P:
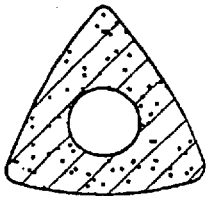
FIG. 9P is a schematic view of a cross-section of another embodiment of a fiber.
Figure 9Q:
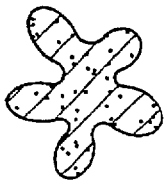
FIG. 9Q is a schematic view of a cross-section of another embodiment of a fiber.
Figure 9R:
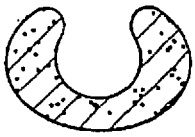
FIG. 9R is a schematic view of a cross-section of another embodiment of a fiber.

As described below with reference to FIGS. 9A through 9R, the fibers 11 may have a wide variety of cross-sections. The fibers 11 may be formed (e.g., by extrusion) to have a substantially flat cross-section as shown in FIG. 9A, a cross-shaped section as shown in FIG. 9B, or a three-branch star shape as shown in FIG. 9C. The cross-section of the fibers 11 may also be hollow as shown in FIG. 9D, or solid with a capillary groove as shown in FIG. 9E. The fibers 11 may also have a cross-section that is U-shaped, as shown in FIG. 9F; I-shaped, as shown in FIG. 9H; C-shaped, as shown in FIG. 9I; V-shaped, as shown in FIG. 9J; Z-shaped, as shown in FIG. 9K; or a combination of the these shapes (e.g., the combination shown in FIG. 9G which combines the shapes that correspond to FIGS. 9B and 9C). FIG. 9L shows an exemplary fiber having a hollow square cross-section; FIG. 9M shows an exemplary fiber having a solid square cross-section; FIG. 9N shows an exemplary fiber having a hollow star-shaped cross-section; FIG. 9P shows an exemplary fiber having a hollow triangular cross-section; FIG. 9Q shows an exemplary fiber having a cross-section that forms peripheral grooves; and FIG. 9R shows an exemplary fiber having a kidney-shaped cross-section.

Figure 11:
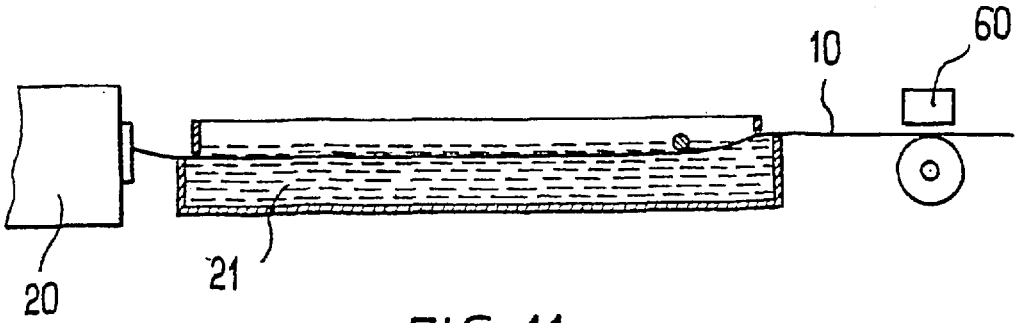
FIG. 11 is a schematic side view of fibers being manufactured according to another embodiment.

The fibers 11 may be exposed to a magnetic field for magnetizing the fibers 11 upon leaving the bath 21 by means of, for example, a magnetizing apparatus 60, as shown in FIG. 11, so as to magnetize the fibers 11 with a predefined polarity. According to an exemplary embodiment, the fibers 11 may also be magnetized after the fibers 11 have been incorporated into an applicator device by subjecting the device, or a batch of such devices, to a magnetizing field. By magnetizing the fibers 11 once they have been placed into an applicator device, it may be possible to limit any risk of the fibers 11 clumping together.

Figure 12:
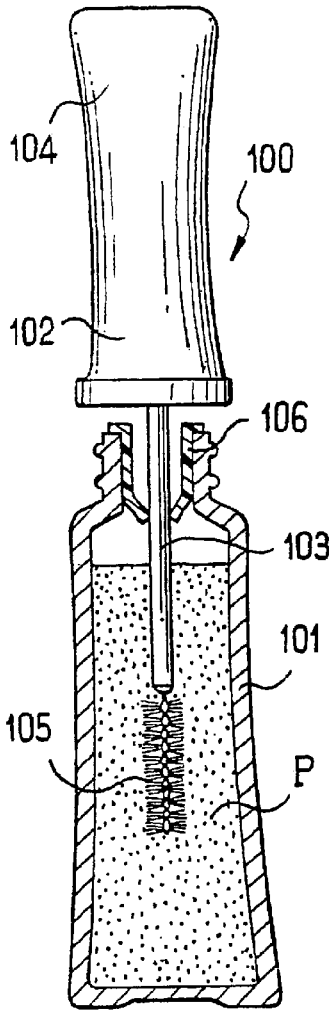
FIG. 12 is a schematic cross-section view of one embodiment of a device for applying a product to a surface.

The fibers 11 may also be used in a variety of devices as described herein. For example, FIG. 12 shows an applicator device 100 comprising a receptacle 101 for containing a product P for application (e.g., a mascara) and an applicator 102. The receptacle 101 may be provided with a wiper member 106 which, in an exemplary embodiment not shown, may be provided with flocking. The applicator 102 may include a stem 103 provided at one end with a handle member 104 that may also constitute a cap for closing the receptacle 101. A brush 105 may be provided at the opposite end of the applicator 102. The brush 105 may include a core comprising twisted wire with bristles being held in the turns of the twisted wire core. The bristles may comprise fibers 11 configured to generate a magnetic field, for example. Alternatively, the bristles might lack any magnetic properties.

Figure 28A:
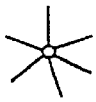
FIG. 28A is a schematic view of an embodiment of fibers influenced by magnetic interaction in one exemplary manner.
Figure 28B:
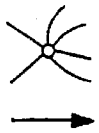
FIG. 28B is a schematic view of an embodiment of fibers influenced by magnetic interaction in another exemplary manner.

The magnetic poles of the brush 105 may be oriented either along the axis of the stem 103 or perpendicularly to the axis of the stem 103, for example. The twisted core may be formed from a non-magnetic material (e.g., a non-magnetic stainless steel) or in another embodiment, the twisted wire core may be formed from a material having magnetic properties. The core may thus interact magnetically with the bristles. The bristles of the brush 105 may be magnetized such that the magnetization of a bristle of the brush 105 acts on adjacent bristles with the magnetic interactions between the bristles being used, for example, to orient the bristles in a desired manner. Depending on the orientation of the magnetic poles of the brush 105, the effect on the orientation of the bristles may differ. For example, FIGS. 28A and 28B show one effect of the bristles of the brush 105 being deflected in the presence of a transverse magnetic field.

The magnetization of the bristles may also be used, during application of a product onto the eyelashes, for example, solely for the purpose of inserting a magnetic field whose action is beneficial on the eyelashes or on some other part of the face (e.g., the eyelids). The magnetic field exerted by the bristles of the brush 105 may vary over time, for example, when the shape of the brush 105 is altered (e.g., while the applicator is being withdrawn from a receptacle or during application of the product).

The product P may present magnetic properties (e.g., the product P may contain particles that are magnetized and/or that are magnetizable). When the product P presents magnetic properties, a brush having bristles which may be configured to generate a magnetic field may encourage loading of the brush with the product P (i.e., by the product P being attracted to the bristles of the brush). The product P may also contain fibers or flakes having magnetic properties and the applicator may interact magnetically with the flakes, for example, to put them into a particular orientation at the time of application (e.g., to encourage sliding of the applicator during application).

Figure 13:
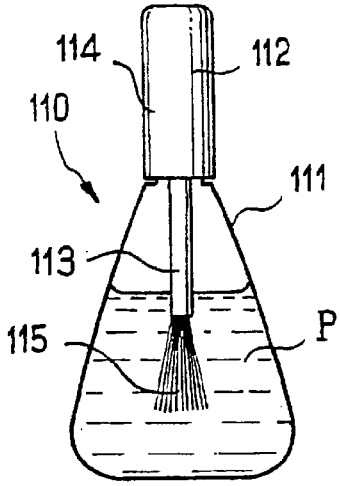
FIG. 13 is a schematic view of another embodiment of a device for applying a product to a surface.
Figure 29A:
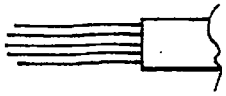
FIG. 29A is a schematic side view of an embodiment of fibers influenced by magnetic interaction in another exemplary manner.
Figure 29B:
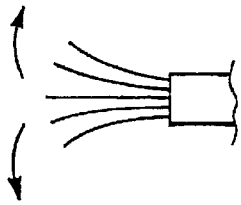
FIG. 29B is a schematic side view of an embodiment of fibers influenced by magnetic interaction in another exemplary manner.

FIG. 13 shows an exemplary embodiment of a device 110 for applying a product (e.g., nail varnish). The device 110 may comprise a receptacle 111 and an applicator 112 comprising a stem 113 provided at one end with a handle member 114 that may also constitute a cap for closing the receptacle 111. The other end of the applicator 112 may be provided with a paintbrush 115 comprising a bundle of bristles placed close together. The bristles may be formed from fibers presenting magnetic properties, which may be useful for bringing the bristles of the brush 115 into a predefined orientation so as to make it easier to load product onto the brush 115 and/or so as to exert an action on the treated surface. Magnetic interactions between the bristles of the paintbrush 115, depending on the polarity of the magnetic field of each brush, may contribute either to bunching the bristles together or to splaying them apart. For example, FIGS. 29A and 29B are schematic representations of one possible effect (i.e., the effect of the bristles being splayed apart due to magnetic interactions between the bristles). The product P may also present magnetic properties.

Figure 14:
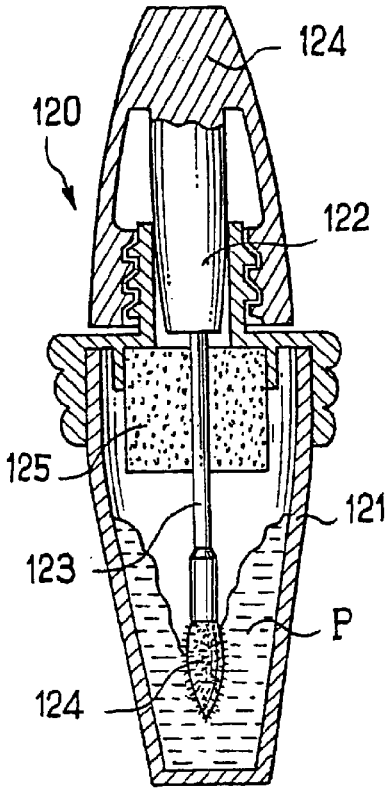
FIG. 14 is a schematic cross-section view of another embodiment of a device for applying a product to a surface.

FIG. 14 shows an exemplary embodiment of an applicator device 120 which may comprise a receptacle 121 containing a product P (e.g., a liquid lipstick) and an applicator 122 comprising a stem 123 provided at one end with a cap 124 for closing the receptacle 121 which may also serve as a handle, and at its other end with an applicator endpiece 124 covered in flocking comprising fibers that are configured to generate a magnetic field. The device 120 may also include a wiper comprising a block of foam 125. The block of foam 125 may present magnetic properties. For example, the block of foam 125 may be magnetized in a certain direction by incorporating magnetized and/or magnetizable particles within the block of foam 125. Magnetizing the wiper may be used, for example, to magnetize the flocking on the endpiece 124 while the applicator 122 is being withdrawn from the receptacle 121.

Figure 15:
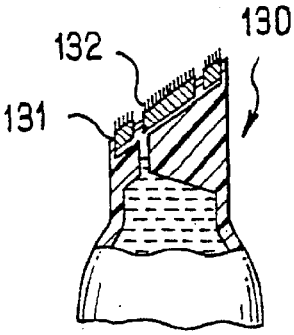
FIG. 15 is a schematic cross-section view of another embodiment of a device for applying a product to a surface.

FIG. 15 shows another exemplary embodiment of an applicator device 130 for a product P (e.g., a liquid lipstick) that may include an endpiece 131 covered by flocking 132 comprising fibers presenting magnetic properties.

Figure 16:
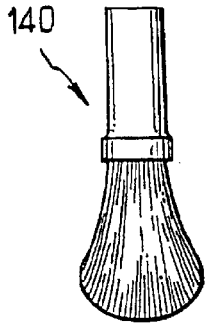
FIG. 16 is a schematic view of a further embodiment of a device for applying a product to a surface.

FIG. 16 shows an exemplary embodiment of a brush 140 for applying a powder, for example, with bristles of the brush being formed using fibers that present magnetic properties.

Figure 17:
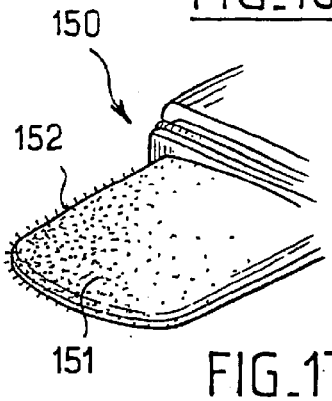
FIG. 17 is a perspective view of another embodiment of a device for applying a product to a surface.

FIG. 17 shows an exemplary embodiment of an applicator 150 comprising a foam member 151 covered on its surface by flocking 152 comprising fibers that present magnetic properties. Such an applicator may be used, for example, to apply blush to the skin.

Figure 18A:
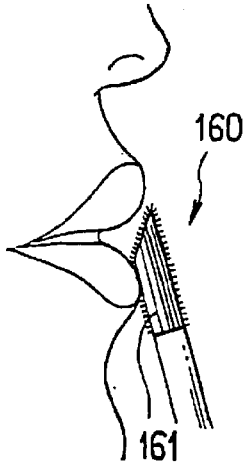
FIG. 18A is a schematic view of another embodiment of a device for applying a product being used according to one exemplary method.
Figure 18B:
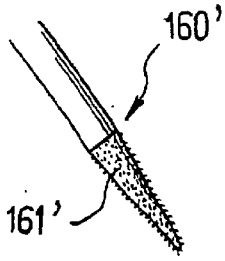
FIG. 18B is a view of a another embodiment of a device for applying a product to a surface.

FIG. 18A shows an exemplary embodiment of a liquid lipstick applicator 160 including an endpiece 161 of material (e.g., an elastomer) provided with flocking, and FIG. 18B shows an exemplary embodiment of an eyeliner 160' including an endpiece 161' of material (e.g., an elastomer) provided with flocking. The flocking may comprise fibers presenting magnetic properties.

Figure 19:
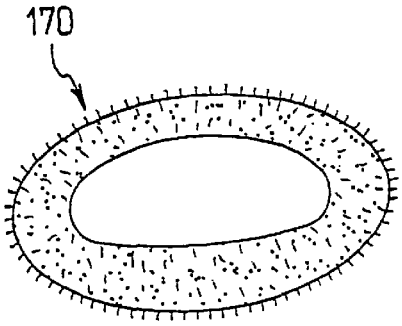
FIG. 19 is a view of another embodiment of a device for applying a product to a surface.
Figure 20:
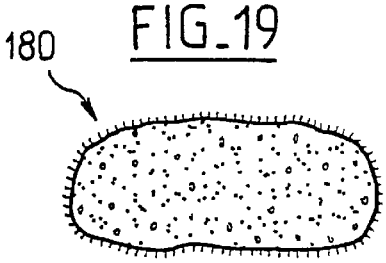
FIG. 20 is a view of another embodiment of a device for applying a product to a surface.
Figure 21:
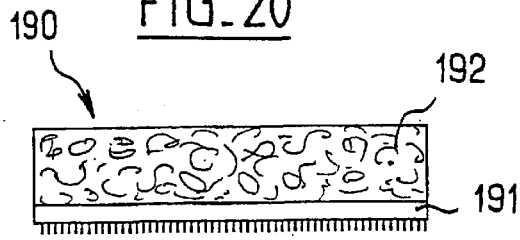
FIG. 21 is a side view of another embodiment of a device for applying a product to a surface.

The fibers may also be used for flocking on an embodiment of a powder puff 170, as shown in FIG. 19, or for flocking on an exemplary embodiment of a make-up removal sponge 180, as shown in FIG. 20. The flocking may also extend on a film 191 fixed on a block of foam 192 of an exemplary embodiment of an applicator 190, as shown in FIG. 21.

Figure 22:
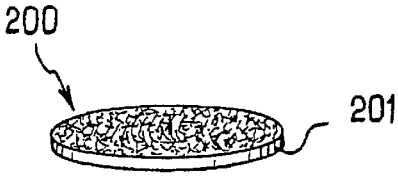
FIG. 22 is a perspective view of another embodiment of a device for applying a product to a surface.

It may also be possible to use fibers that present magnetic properties in a disk or wiper 200 comprising at least one layer 201 of a woven or non-woven fabric incorporating such fibers, as shown in FIG. 22.

Figure 23:
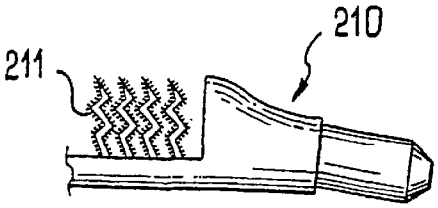
FIG. 23 is a view of another embodiment of a device for applying a product to a surface.

FIG. 23 shows an exemplary embodiment of a comb 210 for applying a product to the eyelashes. The comb may include teeth 211 provided with flocking. The flocking may be formed using fibers having magnetic properties.

Figure 24:
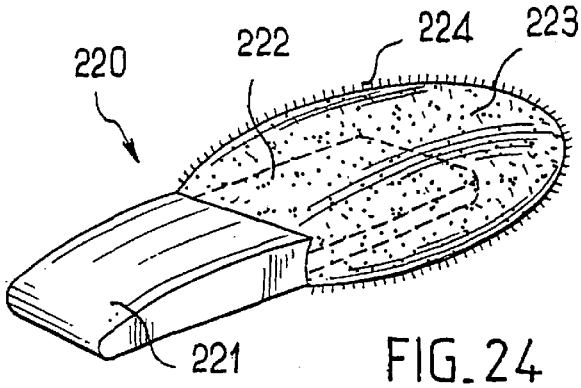
FIG. 24 is a perspective view of another embodiment of a device for applying a product to a surface.
Figure 27:
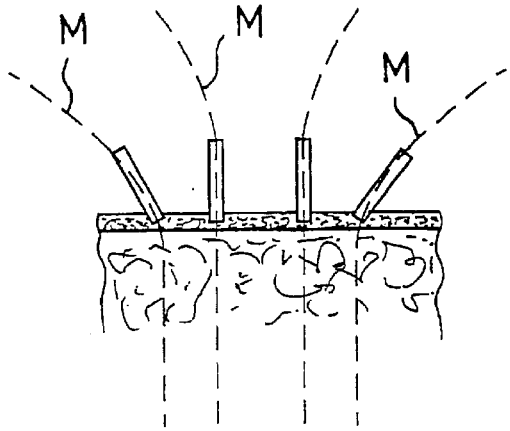
FIG. 27 is a schematic side view of fibers according to one embodiment being influenced by magnetic field lines in an exemplary manner.

According to an exemplary embodiment, an applicator may include one or more one-piece magnets in addition to fibers having magnetic properties. For example, FIG. 24 shows an applicator 220 comprising a handle 221 with a magnet 222 fixed thereto. The magnet 222 may be covered by a block of foam 223. The block of foam 223 may be provided with flocking 224 comprising fibers presenting magnetic properties. The presence of the magnet 222 may subject the flocking 294 to a magnetic field. For example, the flocking having fibers that extend substantially perpendicularly to the underlying support may become oriented along magnetic field lines M, as shown in FIG. 27. The fibers may tend to stand up on the surface of the applicator 220 or may tend to take on other orientations depending on their position relative to the magnet 222. This may make it possible, for example, to load more product onto the applicator 220, which may result in making application of the product softer. In addition, when the product is a powder that is brought into contact with the applicator 220, and when the applicator 220 has magnetic properties, the particles of powder may tend to become deposited on the applicator 220 (e.g., on its fibers), thereby reducing the risk of the powder being blown about, which may induce sneezing.

Figure 25:
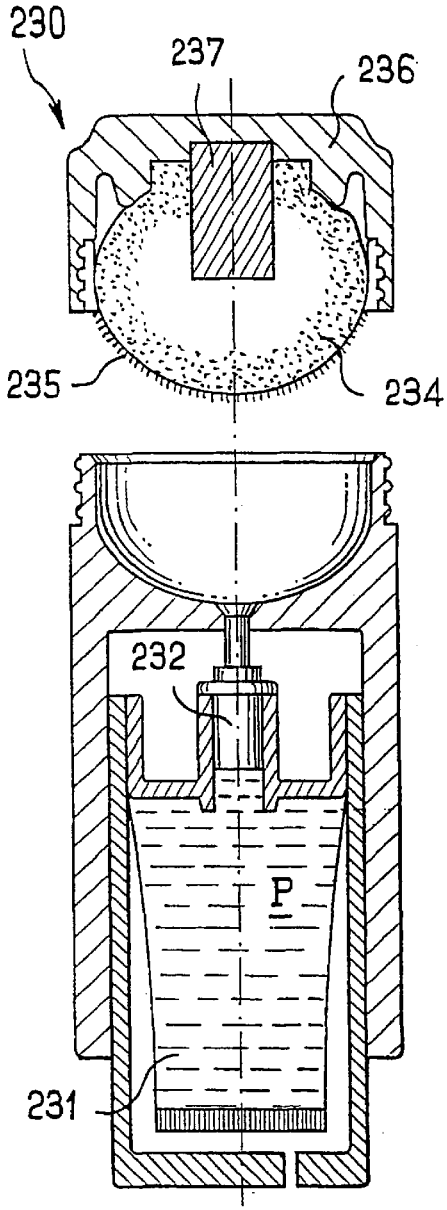
FIG. 25 is a schematic cross-section view of another embodiment of a device for applying a product to a surface.

FIG. 25 shows an exemplary embodiment of a device 230 in which the product may be contained in a flexible bag 231 surmounted by a pump 232. The applicator may include a foam element 234 coated on a surface with flocking 235 and secured to a cap 236. A magnet 237 may be received in the foam element 234 and may be carried by the cap 236. The flocking 235 may present magnetic properties and may be subjected to the magnetic field of the magnet 237, as described previously herein.

Figure 30:
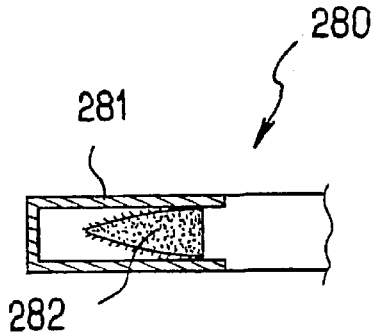
FIG. 30 is a partial cross-section view of another embodiment of a device for applying a product to a surface.

FIG. 30 shows a portion of an exemplary applicator 280 comprising flocking on an endpiece 282, which may be received in a cap 281 when not in use. By using fibers that contain particles which absorb water or which swell in water, it may be possible to maintain moist conditions within the cap 281, such that the endpiece 282 dries out more slowly. In another aspect, the endpiece 282 could be replaced by some other applicator element (e.g., a brush).

Figure 26:
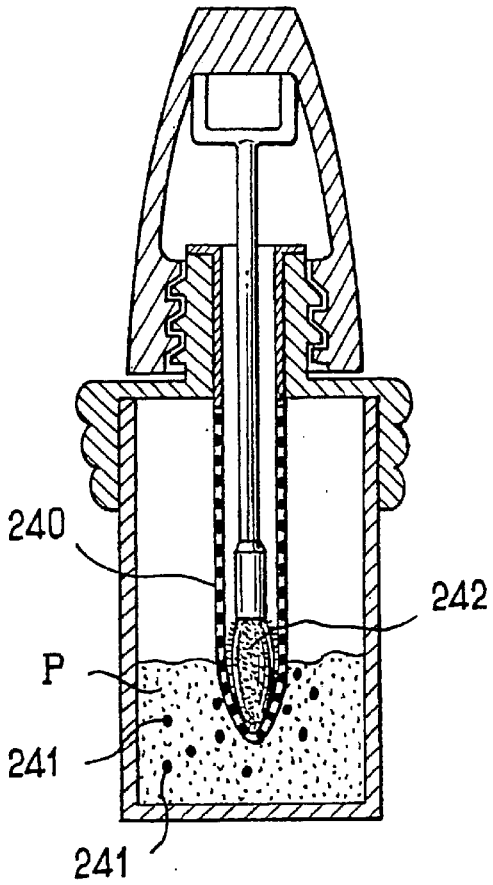
FIG. 26 is a schematic cross-section view of another embodiment of a device for applying a product to a surface.

Naturally, the invention is not limited to the embodiments described above. For example, it may be possible to provide a screen 240 between an applicator and a product contained in a receptacle, as shown in FIG. 26. Under such circumstances, the product P may contain magnetic particles 241 and the applicator may present magnetic properties (e.g., because it comprises an endpiece provided with flocking comprising magnetized and/or magnetizable fibers). The endpiece 240 may be capable of attracting the magnetic particles 241 contained in the product. By selecting a proper mesh size for the screen 240, it may be possible to ensure that the magnetic particles 241 attracted by the endpiece 242 are substantially prevented from passing through the screen 240, while still serving to move the product P towards the endpiece 242, thereby improving loading of the endpiece 242 with product. In another aspect, the product P may itself present magnetic properties (e.g., containing coated magnetic particles) and may pass through the mesh of the screen 240.

In addition, the fibers may be magnetized over only a fraction of their length. The applicator devices described above may include fibers having magnetic properties mixed with fibers that do not have magnetic properties (e.g., fibers that are filled with particles of a material for absorbing liquid (e.g., water), and/or particles suitable for swelling on contact with a liquid, and/or particles capable of dissolving on contact with the liquid).

The device and system according to some exemplary embodiments of the invention may be used to apply any cosmetic or care products, such as make-up, dermatological, or pharmaceutical compositions used for treating and/or changing the appearance of eyelashes, hair, skin, lips, or nails. However, in its broadest aspects, the present invention could be used to apply many other substances.

Furthermore, sizes of various structural parts and materials used to make the above-mentioned parts are illustrative and exemplary only, and one of ordinary skill in the art would recognize that these sizes and materials can be changed as necessary to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for applying a make-up product, the device comprising:

an applicator element comprising a plurality of fibers, wherein the applicator element is configured to apply a make-up product, and wherein at least one of the fibers comprises at least one particle configured to generate a magnetic field.

2. The device of claim 1, wherein at least one of the fibers comprises a synthetic material.

3. The device of claim 1, wherein at least one of the fibers has a cross-section that is substantially constant.

4. The device of claim 1, wherein at least one of the fibers is formed by one of extruding and co-extruding at least one of a thermoplastic material and an elastomeric material.

5. The device of claim 1, wherein at least one of the fibers comprises a coating comprising magnetic particles.

6. The device of claim 1, wherein the at least one particle at least partially comprises at least one material chosen from soft magnetic materials, hard magnetic materials, ferrites, ferrites based on zinc, ferrites based on nickel, ferrites based on manganese, rare earth elements, barium sulfates, silicon iron alloys, cobalt irons, and cobalt irons filled with molybdenum.

7. The device of claim 1, wherein the at least one particle comprises at least one coated magnetic particle.

8. The device of claim 1, wherein the at least one particle comprises at least one magnetic particle comprising a magnetic substance deposited on a non-magnetic medium.

9. The device of claim 1, wherein at least one of the fibers comprises one of magnetized particles and magnetizable particles in an amount ranging from about 0.2% to about 30% by weight.

10. The device of claim 1, wherein at least one of the fibers comprises at least one plastic material chosen from polyamides, PETs, acetates, PEs, PPs, PVCs, amide block polyesters, plasticized RILSAN, elastomers, polyester elastomers, PE elastomers, silicone elastomers, and nitril elastomers.

11. The device of claim 1, wherein the at least one particle is at the surface of the at least one fiber.

12. The device of claim 1, wherein the at least one fiber comprises magnetic particles only at the surface of the at least one fiber.

13. The device of claim 1, wherein the at least one fiber comprises magnetic particles solely inside the at least one fiber.

14. The device of claim 1, wherein the at least one fiber comprises magnetic particles dispersed throughout the at least one fiber.

15. The device of claim 1, wherein the cross-section of at least one of the fibers has at least one shape chosen from circularly symmetric shapes, circular shapes, solid square shapes, hollow square shapes, disk shapes, disk shapes having a groove, solid triangle shapes, hollow triangle shapes, solid star shapes, hollow star shapes, U-shaped, V-shaped, I-shaped, T-shaped, Z-shaped, dash-shaped, cross-shaped, kidney-shaped, shapes having three branches, and hollow shapes.

16. The device of claim 15, wherein the at least one fiber having a cross-section shape is twisted.

17. The device of claim 1, wherein at least one of the fibers is magnetized.

18. The device of claim 1, further comprising a wiper member.

19. The device of claim 18, wherein the wiper member is configured to generate a magnetic field.

20. The device of claim 1, wherein the applicator element is configured to be loaded with the make-up product.

21. The device of claim 1, further comprising a receptacle.

22. The device of claim 21, further comprising a make-up product contained in the receptacle, wherein the applicator element and the make-up product are configured such that the make-up product is attracted to the applicator element.

23. The device of claim 22, wherein the applicator element and the make-up product are configured such that the make-up product is attracted to the at least one fiber.

24. The device of claim 21, further comprising make-up product contained in the receptacle, the make-up product comprising magnetized particles, wherein the at least one fiber is configured to interact with the magnetized particles of the make-up product.

25. The device of claim 1, wherein the applicator element is a mascara brush comprising a plurality of bristles, and wherein at least one of the bristles comprises at least one of the fibers.

26. The device of claim 25, wherein the mascara brush further comprises a magnetized core, wherein the magnetized core is twisted such that the plurality of bristles are connected to the magnetized core.

27. The device of claim 1, wherein the applicator element comprises a paint brush comprising a plurality of bristles, and wherein at least one of the bristles comprises at least one of the fibers.

28. The device of claim 1, wherein the applicator element comprises a flocking comprising the plurality of fibers.

29. The device of claim 28, wherein the device is configured so that flocking covers at least a portion of one of teeth, bristles, a wiper, a foam member, a porous member, a film, a perforated film, an endpiece, a woven fabric, and a non-woven fabric.

30. The device of claim 1, wherein the applicator element comprises one of a woven fabric, a non-woven fabric, and a felt comprising the plurality of fibers.

31. The device of claim 1, wherein the plurality of fibers are exposed to a magnetic field.

32. The device of claim 1, further comprising a make-up product comprising a plurality of fibers, at least one of the plurality of fibers of the make-up product comprising at least one particle configured to generate a magnetic field.

33. The device of claim 1, wherein at least one of the fibers has a diameter ranging from about 0.5 $\mu$m to about 500 $\mu$m.

34. The device of claim 1, wherein at least one of the fibers has a length ranging from about 0.5 mm to about 50 mm.

35. The device of claim 1, wherein the plurality of fibers comprise flocking on an application surface of the application element.

36. The device of claim 1, wherein the plurality of fibers comprises a plurality of bristles.

37. The device of claim 36, wherein the applicator element defines an axis and the plurality of bristles extend in substantially the same direction as the axis of the applicator element.

38. The device of claim 36, wherein the applicator element further comprises branches of wire holding the plurality of bristles.

39. The device of claim 1, further comprising a receptacle containing make-up product.

40. The device of claim 39, wherein the receptacle has an opening configured to receive the applicator element.

41. A method of manufacturing the device of claim 1, the method comprising:

exposing the plurality of fibers to a magnetic field.

42. The method of claim 41, wherein exposing the fibers to a magnetic field arranges the plurality of fibers in a desired orientation.

43. A device for applying a product, the device comprising:

an applicator element comprising a plurality of fibers, wherein the applicator element is configured to apply a cosmetic product other than toothpaste, and wherein at least one of the plurality of fibers comprises a plurality of particles configured to generate a magnetic field.

44. The device of claim 43, wherein at least one of the fibers comprises a synthetic material.

45. The device of claim 43, wherein at least one of the fibers has a cross-section that is substantially constant.

46. The device of claim 43, wherein at least one of the fibers is formed by one of extruding and co-extruding at least one of a thermoplastic material and an elastomeric material.

47. The device of claim 43, wherein at least one of the fibers comprises a coating comprising magnetic particles.

48. The device of claim 43, wherein the particles at least partially comprise at least one material chosen from soft magnetic materials, hard magnetic materials, ferrites, ferrites based on zinc, ferrites based on nickel, ferrites based on manganese, rare earth elements, barium sulfates, silicon iron alloys, cobalt irons, and cobalt irons filled with molybdenum.

49. The device of claim 43, wherein at least one of the fibers comprises one of magnetized particles and magnetizable particles in an amount ranging from about 0.2% to about 30% by weight.

50. The device of claim 43, wherein at least one of the fibers comprises at least one of a plastic material chosen from polyamides, PETs, acetates, PEs, PPs, PVCs, amide block polyesters, plasticized RILSAN, elastomers, polyester elastomers, PE elastomers, silicone elastomers, and nitril elastomers.

51. The device of claim 43, wherein at least one of the fibers comprises magnetic particles at its surface.

52. The device of claim 43, wherein at least one of the fibers comprises magnetic particles only at its surface.

53. The device of claim 43, wherein at least one of the fibers comprises magnetic particles solely inside.

54. The device of claim 43, wherein at least one of the fibers comprises magnetic particles dispersed throughout.

55. The device of claim 43, wherein the cross-section of at least one of the fibers has at least one shape chosen from circularly symmetric shapes, circular shapes, solid square shapes, hollow square shapes, disk shapes, disk shapes having a groove, solid triangle shapes, hollow triangle shapes, solid star shapes, hollow star shapes, U-shaped, V-shaped, I-shaped, T-shaped, Z-shaped, dash-shaped, cross-shaped, kidney-shaped, shapes having three branches, and hollow shapes.

56. The device of claim 55, wherein the at least one fiber having a cross-section shape is twisted.

57. The device of claim 43, wherein at least one of the fibers is magnetized.

58. The device of claim 43, wherein the applicator element is configured to be loaded with a product.

59. The device of claim 43, further comprising a receptacle.

60. The device of claim 59, further comprising product contained in the receptacle, the product comprising magnetized particles, wherein at least one of the fibers is configured to interact with the magnetized particles of the product.

61. The device of claim 43, wherein the applicator element comprises a paint brush comprising a plurality of bristles, and wherein at least one of the bristles comprises at least one of the fibers.

62. The device of claim 43, wherein the plurality of fibers are exposed to a magnetic field.

63. The device of claim 43, wherein at least one of the fibers has a diameter ranging from about 0.5 $\mu$m to about 500 $\mu$m.

64. The device of claim 43, wherein at least one of the fibers has a length ranging from about 0.5 mm to about 50 mm.

65. The device of claim 43, wherein the plurality of fibers comprise flocking on an application surface of the applicator element.

66. The device of claim 43, wherein the plurality of fibers comprises a plurality of bristles.

67. The device of claim 43, further comprising a receptacle containing product.

68. A method of manufacturing the device of claim 43, the method comprising:

exposing the plurality of fibers to a magnetic field.

69. The method of claim 68, wherein exposing the fibers to a magnetic field arranges the plurality of fibers in a desired orientation.

70. A device for applying a product, the device comprising:

an applicator element comprising a plurality of fibers, wherein at least one of the plurality of fibers comprises a plurality of particles configured to generate a magnetic field, and wherein the particles comprises coated magnetic particles.

71. A device for applying a product, the device comprising:

an applicator element comprising a plurality of fibers, wherein at least one of the plurality of fibers comprises a plurality of particles configured to generate a magnetic field, and wherein the particles comprise magnetic particles comprising a magnetic substance deposited on a non-magnetic medium.

72. A device for applying a product, the device comprising:

an applicator element comprising a plurality of fibers; and a wiper member, wherein at least one of the plurality of fibers comprises a plurality of particles configured to generate a magnetic field.

73. The device of claim 72, wherein the wiper member is configured to generate a magnetic field.

74. A device for applying a product, the device comprising:

an applicator element comprising a plurality of fibers;

a receptacle; and a product contained in the receptacle, wherein at least one of the plurality of fibers comprises a plurality of particles configured to generate a magnetic field, and wherein the applicator element and the product are configured such that the product is attracted to the applicator element.

75. The device of claim 74, wherein the applicator element and the product are configured such that the product is attracted to the at least one fiber.

76. A device for applying a product, the device comprising:

an applicator element comprising a plurality of fibers, wherein at least one of the plurality of fibers comprises a plurality of particles configured to generate a magnetic field, wherein the applicator element is a mascara brush comprising a plurality of bristles, and wherein at least one of the bristles comprises at least one of the fibers.

77. The device of claim 76, wherein the mascara brush further comprises a magnetized core, wherein the magnetized core is twisted such that the plurality of bristles are connected to the magnetized core.

78. A device for applying a product, the device comprising:

an applicator element comprising a plurality of fibers, wherein at least one of the plurality of fibers comprises a plurality of particles configured to generate a magnetic field, and wherein the applicator element comprises a flocking comprising the plurality of fibers.

79. The device of claim 78, wherein device is configured so that the flocking covers at least a portion of one of teeth, bristles, a wiper, a foam member, a porous member, a film, a perforated film, an endpiece, a woven fabric, and a non-woven fabric.

80. A device for applying a product, the device comprising:

an applicator element comprising a plurality of fibers, wherein at least one of the plurality of fibers comprises a plurality of particles configured to generate a magnetic field, and wherein the applicator element comprises one of a woven fabric, a non-woven fabric, and a felt comprising the plurality of fibers.

81. A device for applying a product, the device comprising:

an applicator element comprising a plurality of fibers, wherein at least one of the plurality of fibers comprises a plurality of particles configured to generate a magnetic field; and a product comprising a plurality of fibers, wherein at least one of the plurality of fibers of the product comprises at least one particle configured to generate a magnetic field.

82. A device for applying a product, the device comprising:

an applicator element having a plurality of bristles comprising a plurality of fibers, wherein at least one of the plurality of fibers comprises a plurality of particles configured to generate a magnetic field, and wherein the applicator element defines an axis and the plurality of bristles extend in substantially the same direction as the axis of the applicator element.

83. A device for applying a product, the device comprising:

an applicator element comprising a plurality of fibers, wherein at least one of the plurality of fibers comprises a plurality of particles configured to generate a magnetic field, and wherein the applicator element further comprises branches of wire holding the plurality of fibers.

84. A device for applying a product, the device comprising:

an applicator element comprising a plurality of fibers; and a receptacle, wherein at least one of the plurality of fibers comprises a plurality of particles configured to generate a magnetic field, and wherein the receptacle has an opening configured to receive the applicator element.

85. A device for applying a product, the device comprising:

an applicator element comprising a porous member, and a plurality of fibers extending from the porous member, wherein at least one of the plurality of fibers comprises at least one magnetic particle configured to generate a magnetic field.

86. The device of claim 85, wherein at least one of the fibers comprises a synthetic material.

87. The device of claim 85, wherein at least one of the fibers has a cross-section that is substantially constant.

88. The device of claim 85, wherein at least one of the fibers is formed by one of extruding and co-extruding at least one of a thermoplastic material and an elastomeric material.

89. The device of claim 85, wherein at least one of the fibers comprises a coating comprising magnetic particles.

90. The device of claim 85, wherein the at least one particle at least partially comprises at least one material chosen from soft magnetic materials, hard magnetic materials, ferrites, ferrites based on zinc, ferrites based on nickel, ferrites based on manganese, rare earth elements, barium sulfates, silicon iron alloys, cobalt irons, and cobalt irons filled with molybdenum.

91. The device of claim 85, wherein the at least one particle comprises coated magnetic particles.

92. The device of claim 85, wherein the at least one particle comprises at least one magnetic particle comprising a magnetic substance deposited on a non-magnetic medium.

93. The device of claim 85, wherein at least one of the fibers comprises one of magnetized particles and magnetizable particles in an amount ranging from about 0.2% to about 30% by weight.

94. The device of claim 85, wherein at least one of the fibers comprises at least one of a plastic material chosen from polyamides, PETs, acetates, PEs, PPs, PVCs, amide block polyesters, plasticized RILSAN, elastomers, polyester elastomers, PE elastomers, silicone elastomers, and nitril elastomers.

95. The device of claim 85, wherein the at least one particle is at the surface of the at least one fiber.

96. The device of claim 85, wherein the at least one fiber comprises magnetic particles only at the surface of the at least one fiber.

97. The device of claim 85, wherein the at least one fiber comprises magnetic particles solely inside the at least one fiber.

98. The device of claim 85, wherein the at least one fiber comprises magnetic particles dispersed throughout the at least one fiber.

99. The device of claim 85, wherein the cross-section of at least one of the fibers has at least one shape chosen from circularly symmetric shapes, circular shapes, solid square shapes, hollow square shapes, disk shapes, disk shapes having a groove, solid triangle shapes, hollow triangle shapes, solid star shapes, hollow star shapes, U-shaped, V-shaped, I-shaped, T-shaped, Z-shaped, dash-shaped, cross-shaped, kidney-shaped, shapes having three branches, and hollow shapes.

100. The device of claim 99, wherein the at least one fiber having the cross-section shape is twisted.

101. The device of claim 85, wherein at least one of the fibers is magnetized.

102. The device of claim 85, wherein the applicator element is configured to be loaded with a product.

103. The device of claim 85, further comprising a receptacle.

104. The device of claim 103, further comprising a product contained in the receptacle, wherein the applicator element and the product are configured such that the product is attracted to the applicator element.

105. The device of claim 104, wherein the applicator element and the product are configured such that the product is attracted to the at least one fiber.

106. The device of claim 103, further comprising product contained in the receptacle, the product comprising magnetized particles, wherein the at least one fiber is configured to interact with the magnetized particles of the product.

107. The device of claim 85, wherein the applicator element comprises a flocking comprising the plurality of fibers.

108. The device of claim 107, wherein the flocking covers at least a portion of the porous member.

109. The device of claim 85, wherein the applicator element comprises one of a woven fabric, a non-woven fabric, and a felt comprising the plurality of fibers.

110. The device of claim 85, wherein the plurality of fibers are exposed to a magnetic field.

111. The device of claim 85, further comprising a product comprising a plurality of fibers, at least one of the plurality of fibers of the product comprising at least one particle configured to generate a magnetic field.

112. The device of claim 85, wherein at least one of the fibers has a diameter ranging from about 0.5 $\mu$m to about 500 $\mu$m.

113. The device of claim 85, wherein at least one of the fibers has a length ranging from about 0.5 mm to about 50 mm.

114. The device of claim 85, wherein the plurality of fibers comprise flocking on an application surface of the applicator element.

115. The device of claim 85, further comprising a receptacle containing product.

116. The device of claim 115, wherein the receptacle has an opening configured to receive the applicator element.

117. A method of manufacturing the device of claim 85, the method comprising:

exposing the plurality of fibers to a magnetic field.

118. The method of claim 117, wherein exposing the fibers to a magnetic field arranges the plurality of fibers in a desired orientation.

119. A device for applying a product, the device comprising:

a core configured to generate a magnetic field; and a plurality of application members associated with the core, wherein at least one of the application members is configured to apply a make-up product.

120. The device of claim 119, wherein the application members are teeth.

121. The device of claim 120, wherein at least some of the teeth are provided with a flocking having magnetic properties.

122. The device of claim 119, wherein the application members are bristles.

123. The device of claim 122, wherein at least some of the bristles have magnetic properties.

124. The device of claim 119, wherein the device is configured in the form of a brush for applying a make-up product, wherein the core defines an axis, wherein the plurality of application members are attached to the core, and wherein the core is configured to create magnetic poles along the axis of the core such that the magnetic poles interact with at least one of the plurality of application members.

125. A device for applying a product, the device comprising:

an applicator element comprising a plurality of fibers configured to be loaded with the product and to apply the loaded product, wherein at least one of the fibers comprises at least one particle configured to generate a magnetic field; and a receptacle configured to contain the product to be applied, the receptacle defining a recess configured to receive the applicator element.

126. The device of claim 125, wherein at least one of the fibers comprises a synthetic material.

127. The device of claim 125, wherein at least one of the fibers has a cross-section that is substantially constant.

128. The device of claim 125, wherein at least one of the fibers is formed by one of extruding and co-extruding at least one of a thermoplastic material and an elastomeric material.

129. The device of claim 125, wherein at least one of the fibers comprises a coating comprising magnetic particles.

130. The device of claim 125, wherein the at least one particle at least partially comprises at least one material chosen from soft magnetic materials, hard magnetic materials, ferrites, ferrites based on zinc, ferrites based on nickel, ferrites based on manganese, rare earth elements, barium sulfates, silicon iron alloys, cobalt irons, and cobalt irons filled with molybdenum.

131. The device of claim 125, wherein the at least one particle comprises at least one coated magnetic particle.

132. The device of claim 125, wherein the at least one particle comprises at least one magnetic particle comprising a magnetic substance deposited on a non-magnetic medium.

133. The device of claim 125, wherein at least one of the fibers comprises one of magnetized particles and magnetizable particles in an amount ranging from about 0.2% to about 30% by weight.

134. The device of claim 125, wherein at least one of the fibers comprises at least one plastic material chosen from polyamides, PETs, acetates, PEs, PPs, PVCs, amide block polyester, plasticized RILSAN, elastomers, polyester elastomers, PE elastomers, silicone elastomers, and nitril elastomers.

135. The device of claim 125, wherein the at least one particle is at the surface of the at least one fiber.

136. The device of claim 125, wherein the at least one fiber comprises magnetic particles only at the surface of the at least one fiber.

137. The device of claim 125, wherein the at least one fiber comprises magnetic particles solely inside the at least one fiber.

138. The device of claim 125, wherein the at least one fiber comprises magnetic particles dispersed throughout the at least one fiber.

139. The device of claim 125, wherein the cross-section of at least one of the fibers has at least one shape chosen from circularly symmetric shapes, circular shapes, solid square shapes, hollow square shapes, disk shapes, disk shapes having a groove, solid triangle shapes, hollow triangle shapes, solid star shapes, hollow star shapes, U-shaped, V-shaped, I-shaped, T-shaped, Z-shaped, dash-shaped, cross-shaped, kidney-shaped, shapes having three branches, and hollow shapes.

140. The device of claim 139, wherein the at least one fiber having the cross-section is twisted.

141. The device of claim 125, wherein at least one of the fibers is magnetized.

142. The device of claim 125, further comprising a wiper member.

143. The device of claim 142, wherein the wiper member is configured to generate a magnetic field.

144. The device of claim 125, wherein the applicator element is configured to be loaded with a product.

145. The device of claim 144, further comprising product contained in the receptacle, the product comprising magnetized particles, wherein the at least one fiber is configured to interact with the magnetized particles of the product.

146. The device of claim 125, further comprising a product contained in the receptacle, wherein the applicator element and the product are configured such that the product is attracted to the applicator element.

147. The device of claim 146, wherein the applicator element and the product are configured such that the product is attracted to the at least one fiber.

148. The device of claim 125, wherein the applicator element is a mascara brush comprising a plurality of bristles, and wherein at least one of the bristles comprises at least one of the fibers.

149. The device of claim 148, wherein the mascara brush further comprises a magnetized core, wherein the magnetized core is twisted such that the plurality of bristles are connected to the magnetized core.

150. The device of claim 125, wherein the applicator element comprises a paint brush comprising a plurality of bristles, and wherein at least one of the bristles comprises at least one of the fibers.

151. The device of claim 125, wherein the applicator element comprises a flocking comprising the plurality of fibers.

152. The device of claim 151, wherein the device is configured so that the flocking covers at least a portion of one of teeth, bristles, a wiper, a foam member, a porous member, a film, a perforated film, an endpiece, a woven fabric, and a non-woven fabric.

153. The device of claim 125, wherein the applicator element comprises one of a woven fabric, a non-woven fabric, and a felt comprising the plurality of fibers.

154. The device of claim 125, wherein the plurality of fibers are exposed to a magnetic field.

155. The device of claim 125, further comprising a product comprising a plurality of fibers, at least one of the plurality of fibers of the product comprising at least one particle configured to generate a magnetic field.

156. The device of claim 125, wherein at least one of the fibers has a diameter ranging from about 0.5 $\mu$m to about 500 $\mu$m.

157. The device of claim 125, wherein at least one of the fibers has a length ranging from about 0.5 mm to about 50 mm.

158. The device of claim 125, wherein the plurality of fibers comprise flocking on an application surface of the applicator element.

159. The device of claim 125, wherein the plurality of fibers comprises a plurality of bristles.

160. The device of claim 159, wherein the applicator element defines an axis and the plurality of bristles extend in substantially the same direction as the axis of the applicator element.

161. The device of claim 159, wherein the applicator element further comprises branches of wire holding the plurality of bristles.

162. The device of claim 125, further comprising a receptacle containing a product.

163. A method of manufacturing the device of claim 125, the method comprising:

exposing the plurality of fibers to a magnetic field.

164. The method of claim 163, wherein exposing the fibers to a magnetic field arranges the plurality of fibers in a desired orientation.

165. A device for applying a product, the device comprising:

an applicator element comprising a flocking comprising a plurality of fibers, wherein at least one of the fibers comprises at least one particle configured to generate a magnetic field.

166. The device of claim 165, wherein at least one of the fibers comprises a synthetic material.

167. The device of claim 165, wherein at least one of the fibers has a cross-section that is substantially constant.

168. The device of claim 165, wherein at least one of the fibers is formed by one of extruding and co-extruding at least one of a thermoplastic material and an elastomeric material.

169. The device of claim 165, wherein at least one of the fibers comprises a coating comprising magnetic particles.

170. The device of claim 165, wherein the at least one particle at least partially comprises at least one material chosen from soft magnetic materials, hard magnetic materials, ferrites, ferrites based on zinc, ferrites based on nickel, ferrites based on manganese, rare earth elements, barium sulfates, silicon iron alloys, cobalt irons, and cobalt irons filled with molybdenum.

171. The device of claim 165, wherein the at least one particle comprises at least one coated magnetic particle.

172. The device of claim 165, wherein the at least one particle comprises at least one magnetic particle comprising a magnetic substance deposited on a non-magnetic medium.

173. The device of claim 165, wherein at least one of the fibers comprises one of magnetized particles and magnetizable particles in an amount ranging from about 0.2% to about 30% by weight.

174. The device of claim 165, wherein at least one of the fibers comprises at least one plastic material chosen from polyamides, PETs, acetates, PEs, PPs, PVCs, amide block polyesters, plasticized RILSAN, elastomers, polyester elastomers, PE elastomers, silicone elastomers, and nitril elastomers.

175. The device of claim 165, wherein the at least one particle is at the surface of the at least one fiber.

176. The device of claim 165, wherein the at least one fiber comprises magnetic particles only at the surface of the at least one fiber.

177. The device of claim 165, wherein the at least one fiber comprises magnetic particles solely inside the at least one fiber.

178. The device of claim 165, wherein the at least one fiber comprises magnetic particles dispersed throughout the at least one fiber.

179. The device of claim 165, wherein the cross-section of at least one of the fibers has at least one shape chosen from circularly symmetric shapes, circular shapes, solid square shapes, hollow square shapes, disk shapes, disk shapes having a groove, solid triangle shapes, hollow triangle shapes, solid star shapes, hollow star shapes, U-shaped, V-shaped, I-shaped, T-shaped, Z-shaped, dash-shaped, cross-shaped, kidney-shaped, shapes having three branches, and hollow shapes.

180. The device of claim 179, wherein the at least one fiber having a cross-section shape is twisted.

181. The device of claim 165, wherein at least one of the fibers is magnetized.

182. The device of claim 165, further comprising a wiper member.

183. The device of claim 182, wherein the wiper member is configured to generate a magnetic field.

184. The device of claim 165, wherein the applicator element is configured to be loaded with the make-up product.

185. The device of claim 165, further comprising a receptacle.

186. The device of claim 185, further comprising make-up product contained in the receptacle, the make-up product comprising magnetized particles, wherein the at least one fiber is configured to interact with the magnetized particles of the make-up product.

187. The device of claim 185, further comprising a make-up product contained in the receptacle, wherein the applicator element and the make-up product are configured such that the make-up product is attracted to the applicator element.

188. The device of claim 187, wherein the applicator element and the make-up product are configured such that the make-up product is attracted to the at least one fiber.

189. The device of claim 165, wherein the device is configured so that flocking covers at least a portion of one of teeth, bristles, a wiper, a foam member, a porous member, a film, a perforated film, an endpiece, a woven fabric, and a non-woven fabric.

190. The device of claim 165, wherein the applicator element comprises one of a woven fabric, a non-woven fabric, and a felt comprising the plurality of fibers.

191. The device of claim 165, wherein the plurality of fibers are exposed to a magnetic field.

192. The device of claim 165, further comprising a make-up product comprising a plurality of fibers, at least one of the plurality of fibers of the make-up product comprising at least one particle configured to generate a magnetic field.

193. The device of claim 165, wherein at least one of the fibers has a diameter ranging from about 0.5 $\mu$m to about 500 $\mu$m.

194. The device of claim 165, wherein at least one of the fibers has a length ranging from about 0.5 mm to about 50 mm.

195. The device of claim 165, further comprising a receptacle containing make-up product.

196. The device of claim 195, wherein the receptacle has an opening configured to receive the applicator element.

197. A method of manufacturing the device of claim 165, the method comprising:

exposing the plurality of fibers to a magnetic field.

198. The method of claim 197, wherein exposing the fibers to a magnetic field arranges the plurality of fibers in a desired orientation.

199. A device for applying a product, the device comprising:

an applicator element defining an axis and comprising a plurality of bristles extending in a direction at least substantially parallel to the axis of the applicator element, wherein at least one of the bristles comprises at least one particle configured to generate a magnetic field.

200. The device of claim 199, wherein the applicator element comprises a brush.

201. The device of claim 199, further comprising a receptacle configured to receive the applicator element.

202. The device of claim 201, wherein the applicator element further comprises a stem and a member configured to close the receptacle.

203. The device of claim 199, wherein the applicator element is configured to generate a magnetic field.

* * * * *

UNITED STATES PATENT AND TRADEMARK OFFICE

CERTIFICATE OF CORRECTION

PATENT NO. : 6,669,389 B2
DATED : December 30, 2003
INVENTOR(S) : Jean-Louis H. Gueret It is certified that error appears in the above-identified patent and that said Letters Patent is hereby corrected as shown below:

Column 16,
Line 38, "particles comprises" should read -- particles comprise --.

Signed and Sealed this

Sixth Day of April, 2004

JON W. DUDAS
*Acting Director of the United States Patent and Trademark Office*